US007059892B1

(12) United States Patent
Trout

(10) Patent No.: US 7,059,892 B1
(45) Date of Patent: Jun. 13, 2006

(54) ELECTRICAL CONNECTOR AND BACKSHELL

(75) Inventor: David Allison Trout, Lancaster, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/022,528

(22) Filed: Dec. 23, 2004

(51) Int. Cl.
*H01R 13/58* (2006.01)

(52) U.S. Cl. ..... 439/465; 439/460; 439/942

(58) Field of Classification Search ..... 439/460, 439/465, 942, 719, 405
See application file for complete search history.

(56) References Cited

U.S. PATENT DOCUMENTS 5,118,306 A * 6/1992 Bixler et al. ..... 439/405
5,899,770 A * 5/1999 Ezawa ..... 439/418
6,019,627 A * 2/2000 Embo et al. ..... 439/412
6,293,829 B1 * 9/2001 Qiao et al. ..... 439/719
6,506,081 B1 * 1/2003 Blanchfield et al. ..... 439/682
6,726,503 B1 * 4/2004 Waddell et al. ..... 439/465

* cited by examiner

*Primary Examiner*—Tho D. Ta
*Assistant Examiner*—Vanessa Girardi

(57) ABSTRACT

An electrical connector assembly includes a connector housing holding a plurality of electrical contacts and a backshell including a backshell housing having a connector receiving end and a cable exit end. The connector housing is coupled to the connector receiving end of the backshell housing. A plurality of organizing elements are within the backshell housing. The organizing elements are arranged in a transverse row within the backshell housing. The organizing elements are configured to receive and support a plurality of electrical cables arranged in first and second transverse rows. The first and second rows are in a tiered relationship with one another and the electrical cables are transversely offset from one another.

22 Claims, 12 Drawing Sheets

ELECTRICAL CONNECTOR AND BACKSHELL

BACKGROUND OF THE INVENTION

The invention relates generally to electrical connectors, and more particularly, to a connector and backshell assembly.

In general, an electrical cable includes one or more conductors, which may be wire conductors, that are surrounded by an insulation layer. Networked electronic systems often include a number of devices communicating with other devices through a number of associated electrical cables with electrical connectors. Typically, one device is connected to another device or system through a single conductor or multiple conductors that are terminated with contacts in a connector housing. To terminate the conductors to the connector contacts, wire insulation is removed from an end of the cable to expose the conductors therein. The conductors are placed into the contacts of the connector and the conductors are attached thereto, such as with crimping or soldering techniques.

It is common to utilize a backshell on an electrical connector to protect the conductors of the electrical cable which are connected to the contacts in the connector. The backshell prevents dust, particles and moisture from entering the rear of the connector. The backshell may also provide strain relief for the cable so that excessive forces applied to the cable will not cause the cable conductors to become disconnected from the contacts in the connector housing.

At least some connector backshells used in the industry today consist of a cast or otherwise formed rear cable support structure and a coupling ring to lock the rear structure to the connector shell. Particularly in circular connectors, where cabling and harness work must be performed, these two parts can become troublesome to handle and may be relatively expensive to manufacture.

It would be desirable to provide a backshell that addresses the deficiencies of those in common use today and further, to provide a backshell design that can be used with a housing for a board mount connector, thereby providing a common connector housing useable for both board mount and cable applications to reduce costs.

BRIEF DESCRIPTION OF THE INVENTION

In one aspect, an electrical connector assembly is provided. The assembly includes a connector housing holding a plurality of electrical contacts and a backshell including a backshell housing having a connector receiving end and a cable exit end. The connector housing is coupled to the connector receiving end of the backshell housing. A plurality of organizing elements are within the backshell housing. The organizing elements are arranged in a transverse row within the backshell housing. The organizing elements are configured to receive and support a plurality of electrical cables arranged in first and second transverse rows. The first and second rows are in a tiered relationship with one another and the electrical cables are transversely offset from one another.

In another aspect, an electrical connector assembly is provided. The assembly includes a connector housing holding a plurality of electrical contacts. The connector housing includes a mating face and a rearward face opposite the mating face. A backshell includes a backshell housing having a connector receiving end and a cable exit end. The connector housing is coupled to the connector receiving end of the backshell housing. A plurality of organizing elements are within the backshell housing. The organizing elements are arranged in a transverse row within the housing. Selected organizing elements include a surface configured to be received in recesses in the rearward face of the connector housing to retain the contacts in the connector housing.

In yet another aspect, a backshell for an electrical connector is provided that includes a backshell housing having a connector receiving end and a cable exit end. A plurality of organizing elements are within the backshell housing. The organizing elements are arranged in a transverse row within the backshell housing. The organizing elements are configured to receive and support a plurality of electrical cables arranged in first and second transverse rows. The first and second rows are in a tiered relationship with one another and are transversely offset from one another.

DETAILED DESCRIPTION OF THE INVENTION

Figure 1:
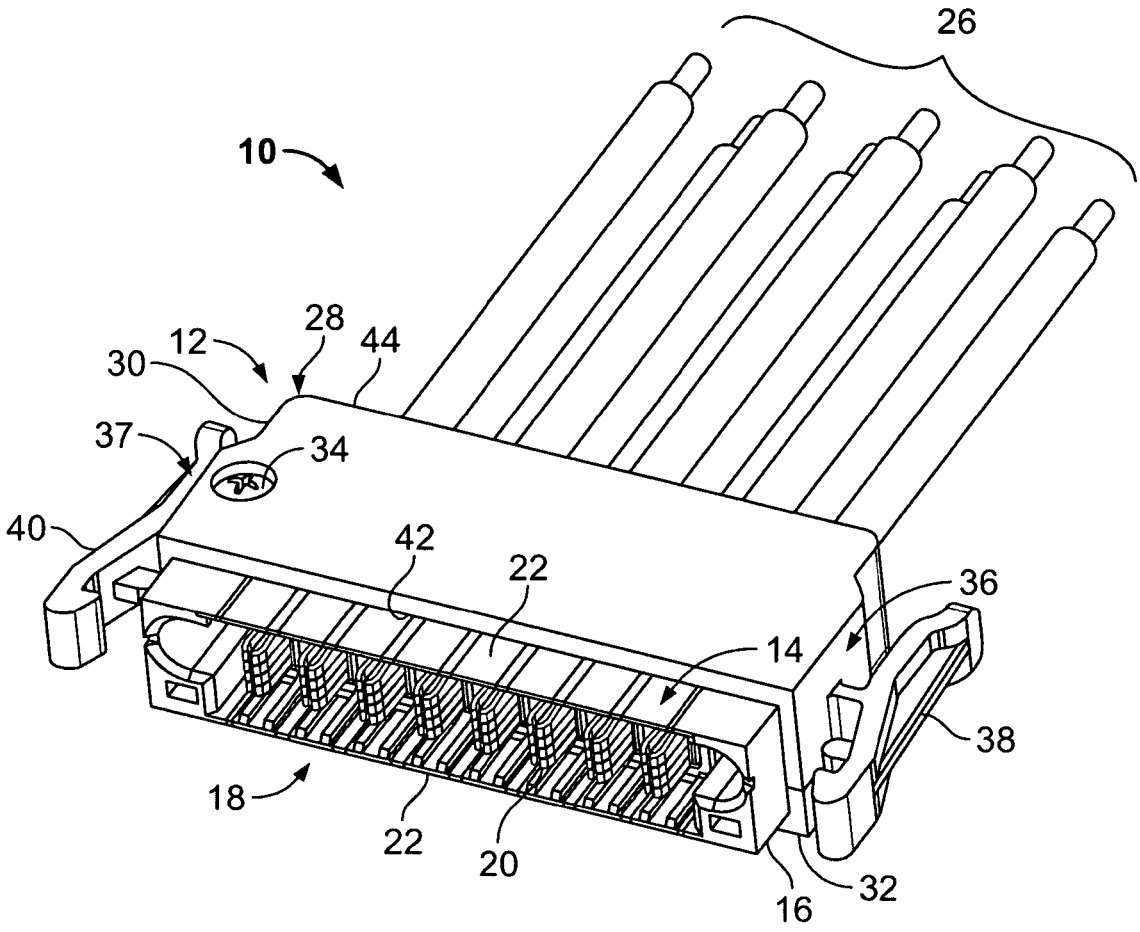
FIG. 1 is perspective view of a connector and backshell assembly formed in accordance with an exemplary embodiment of the present invention.

FIG. 1 is perspective view of a connector and backshell assembly 10 formed according to an embodiment of the present invention. While the connector and backshell assembly 10 will be described with particular reference to a header connector, it is to be understood that the benefits herein described are also applicable to other connectors in alternative embodiments. The following description is therefore provided for purposes of illustration, rather than limitation, and is but one potential application of the inventive concepts herein.

The assembly 10 includes a backshell 12 and a connector 14. In an exemplary embodiment, the connector 14 is a header or plug connector. The connector 14 includes a housing 16 formed from a dielectric material. The housing 16 includes a forward mating face 18. A plurality of contacts 20 are surrounded by a shroud 22 at the mating face 18 of the connector 16. The contacts 20 are joined to a plurality of cables 26 that extend from a cable exit end 44 of the backshell 12.

The backshell 12 includes a housing 28 that includes an upper portion 30 and a lower portion 32. The backshell upper and lower housing portions 30 and 32 respectively are held together by fasteners 34. In the embodiment shown in FIG. 1, one fastener 34 is visible in the upper backshell housing 30. A second fastener (not shown) joins the lower backshell housing 32 to the upper backshell housing 30 from an underside of the lower backshell housing 32. In one embodiment, the fasteners 34 are self tapping screws, although other fasteners may be utilized in other embodiments.

The upper backshell housing 30 and lower backshell housing 32 of the backshell 12 cooperate to form opposed side walls 36 and 37. A latch member 38 is formed on the side wall 36 and a similar latch member 40 is formed on the side wall 37. The latch members 38 and 40 are provided to retain the connector assembly 10 to a mating connector (not shown). In one embodiment, latch members 38 and 40 are squeeze-to-release latches. The latch member 38 is formed on the upper backshell housing 30 while the latch member 40 is formed on the lower backshell housing 32. The backshell 12 includes a connector receiving end 42 and a cable exit end 44. The connector 14 is received in the connector receiving end 42 of backshell 12 and cables 26 exit the cable exit end 44 of the backshell 12.

Figure 2:
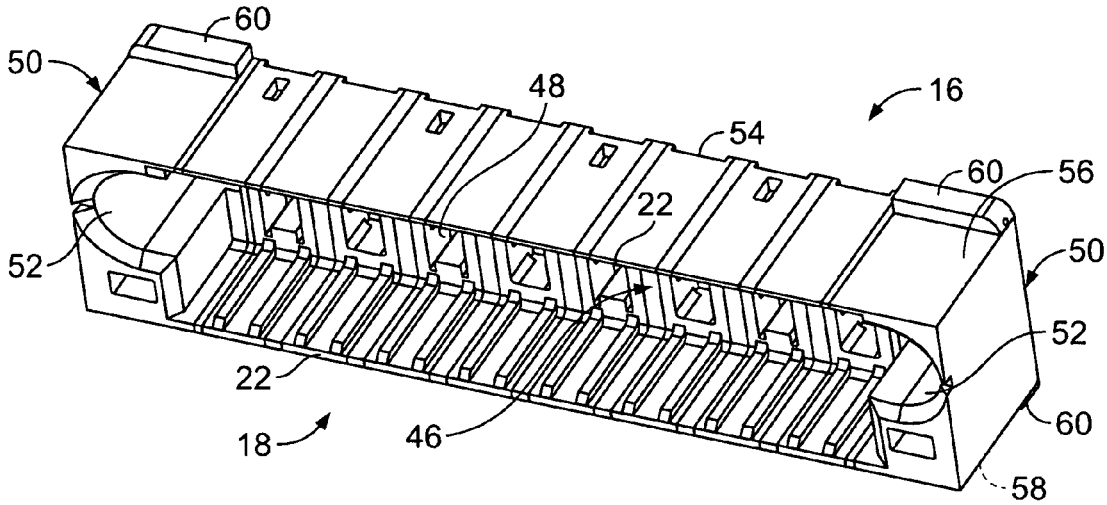
FIG. 2 is a front perspective view of the connector housing shown in FIG. 1.

FIG. 2 is a front perspective view of the housing 16 of the header connector 14. The connector housing 16 includes a main body 46 from which the shroud 22 extends. The body 46 includes a plurality of contact cavities 48. The connector housing 16 also includes end portions 50 each of which includes a guidepost channel 52 that extends from the forward mating face 18 to a rearward face 54 of the main body 46 and the connector housing 16. The guidepost channels 52 are sized and configured to receive a guidepost (not shown) from a mating connector (not shown) to position and align the connector housing 16 with the mating connector. In one embodiment, the mating connector may be a board mounted receptacle. The end portions 50 also include upper and lower surfaces 56 and 58, respectively. Protrusions 60 extend from the upper and lower surfaces 56 and 58, respectively, proximate the rearward face 54 of the connector housing 16.

Figure 3:
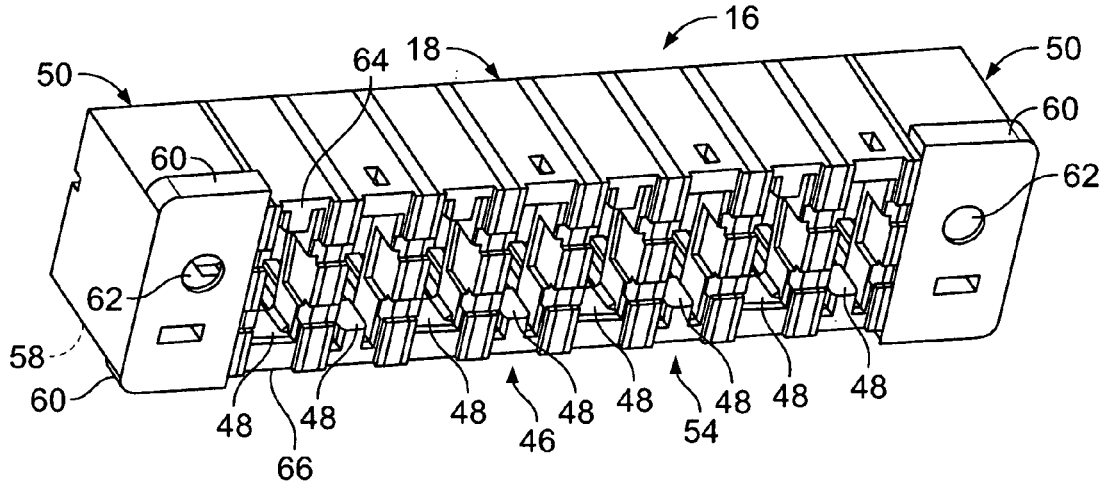
FIG. 3 is a rear perspective view of the connector housing shown in FIG. 2.

FIG. 3 is a rear perspective view of the connector housing 16. Each of the guidepost channels 52 terminates at a guidepost hole 62 in the end portions 50 proximate the rearward face 54 of the connector housing 16. The guidepost holes 62 are configured to receive a conical tip of the guidepost (not shown) of the mating connector (not shown). The rearward face 54 of the main body 46 includes a plurality of recessed areas 64 at a rearward end 66 of each contact cavity 48.

Figure 4:
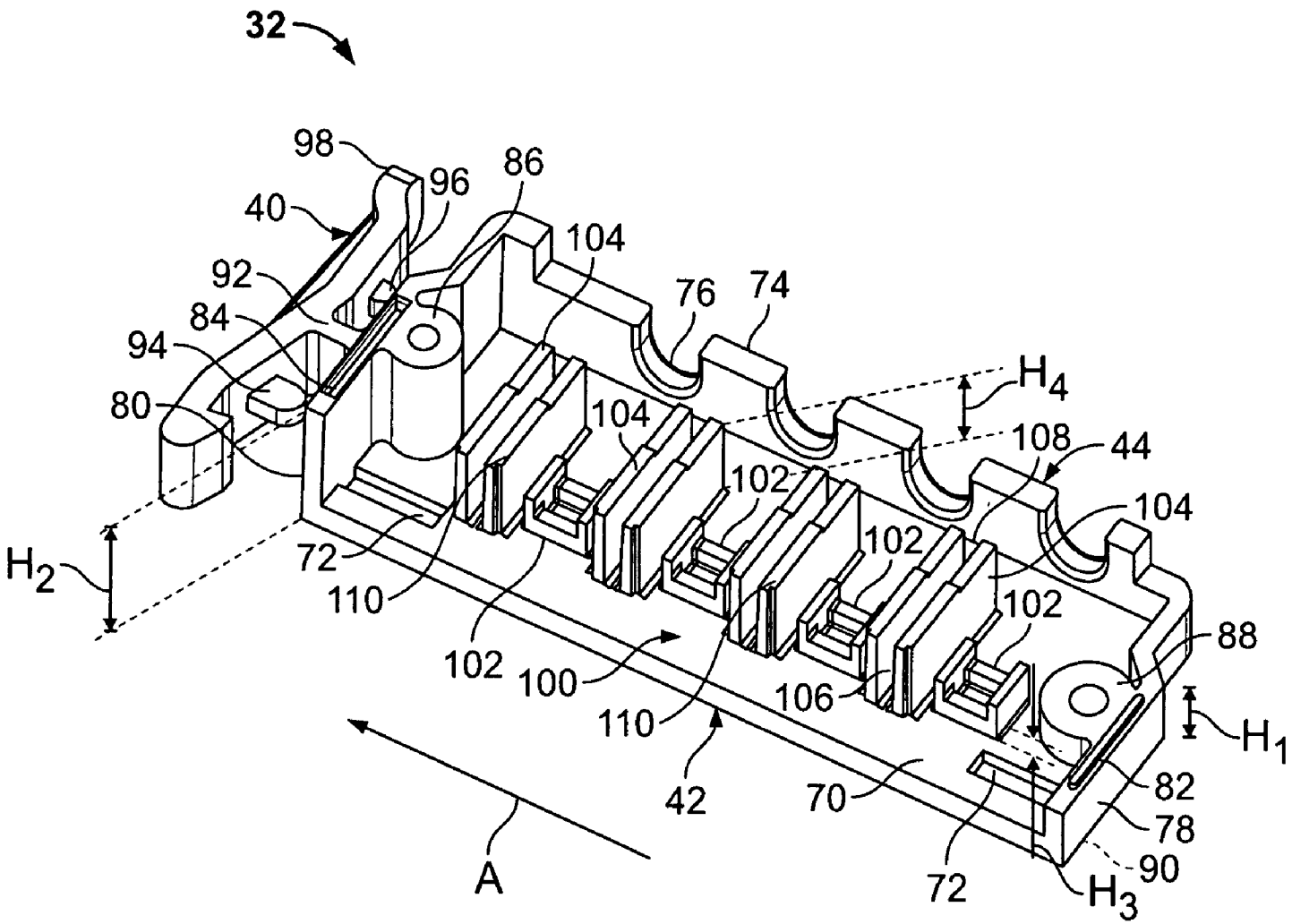
FIG. 4 is a perspective view of the lower housing portion of the backshell shown in FIG. 1.

FIG. 4 is a perspective view of the lower backshell housing 32. The lower backshell housing 32 includes a floor 70 that includes receptacles or recesses 72 proximate the connector receiving end 42. The receptacles 72 are configured to receive the protrusions 60 on the connector housing 16 (see FIGS. 2 and 3). The receptacles 72 and protrusions 60 cooperate to locate or provide positional accuracy for the connector housing 16 relative to the backshell 12 and to retain the connector housing 16 in the connector receiving end 42 of the backshell 12 when the upper backshell housing 30 is coupled to the lower backshell housing 32. In one embodiment, the protrusions 60 and receptacles 72 are rectangular in shape. It is to be understood, however, that other shapes may be employed in other embodiments. Additionally, in accordance with other contemplated embodiments, the placement of the protrusions 60 and the recesses 72 may be reversed with the protrusions 60 being located in the backshell 12 and the recesses 72 being located on the connector housing 16. The lower backshell housing 32 also includes a rear wall 74 that includes a plurality of cable exit channels 76.

The lower backshell housing 32 includes a first lower side wall 78 and a second opposite lower side wall 80. The first lower side wall 78 forms a lower portion of the side wall 36 (FIG. 1). The second lower side wall 80 forms a lower portion of the side wall 37 (FIG. 1). The first lower side wall 78 includes a key element 82 and the second lower side wall 80 includes a recess 84 that is complimentary in shape with the key element 82. The backshell upper housing 30 (FIG. 1) includes corresponding key and recess features that are provided to align the upper and lower backshell housings 30 and 32, respectively, for assembly. A post 86 is formed at the interior of the side wall 80 to receive the fastener 34 (FIG. 1). An embossment 88 is formed at the interior of the side wall 78 that receives a fastener 34 from a lower exterior surface 90 of the floor 70.

In the embodiment shown in FIG. 4, the first lower side wall 78 has a height $H_1$ that is less than a height $H_2$ of the second lower side wall 80. The latch member 40 is formed on the second lower side wall 80. In one embodiment, the latch body is integrally formed on the second lower side wall 80 and includes a living hinge 92. The latch member 40 also includes overstress limiters 94 and 96 that prevent overstress damage to the latch member 40. A thumb pad 98 is provided for operation of the latch member 40. The latch member 38 (FIG. 1) is formed on a side wall of the upper backshell housing 30 (FIG. 1) and is substantially identical in construction to the latch member 40.

The lower backshell housing 32 also includes a plurality of organizing elements 100 that are arranged in a transverse row along the housing floor 70 in the direction of the arrow A. The organizing elements 100 include alternating terminal cradle elements 102 and terminal retention elements 104. A similar row of organizing elements 100 is formed in the upper backshell housing 30 (not shown) and is aligned opposite the row in the lower backshell housing 32. The terminal cradle elements 102 and the terminal retention elements 104 in the upper backshelll housing 30 (not shown) are offset transversely from like elements in the lower backshell housing 32 such that a terminal cradle element 102 on the lower backshell housing 32 is opposed by a terminal retention element 104 on the upper backshell housing 30. While the terminal retention elements 104, are shown in FIG. 4 with open front and rear ends 106 and 108 respectively, in alternative embodiments the front and rear ends 106 and 108 may be closed or are joined together. The terminal retention elements 104 include stepped cable engagement surfaces 110. The terminal cradle elements 102 and terminal retention elements 104 that comprise the organizing elements 100 cooperate to arrange the plurality of electrical cables 26 in first and second transverse rows wherein the first and second transverse rows are in a tiered relationship with one another and transversely offset from one another as will be described.

Each terminal cradle element 102 defines a third height $H_3$ and each terminal retention element 104 defines a fourth height $H_4$ that is greater then the third height $H_3$. The terminal cradle elements 102 define a first transverse row of electrical cables at a height $H_3$ above the floor 70 of the lower backshell housing portion 32. The terminal retention elements 104 define a second transverse row of electrical cables that is positioned at a height $H_4$ relative to the floor 70 of the lower backshell housing 32. Thus, the terminal cradle elements and the terminal retention elements cooperate to arrange the plurality of electrical cables 26 in first and second transverse rows within the backshell 12 that are in a tiered relationship with one another.

Figure 5:
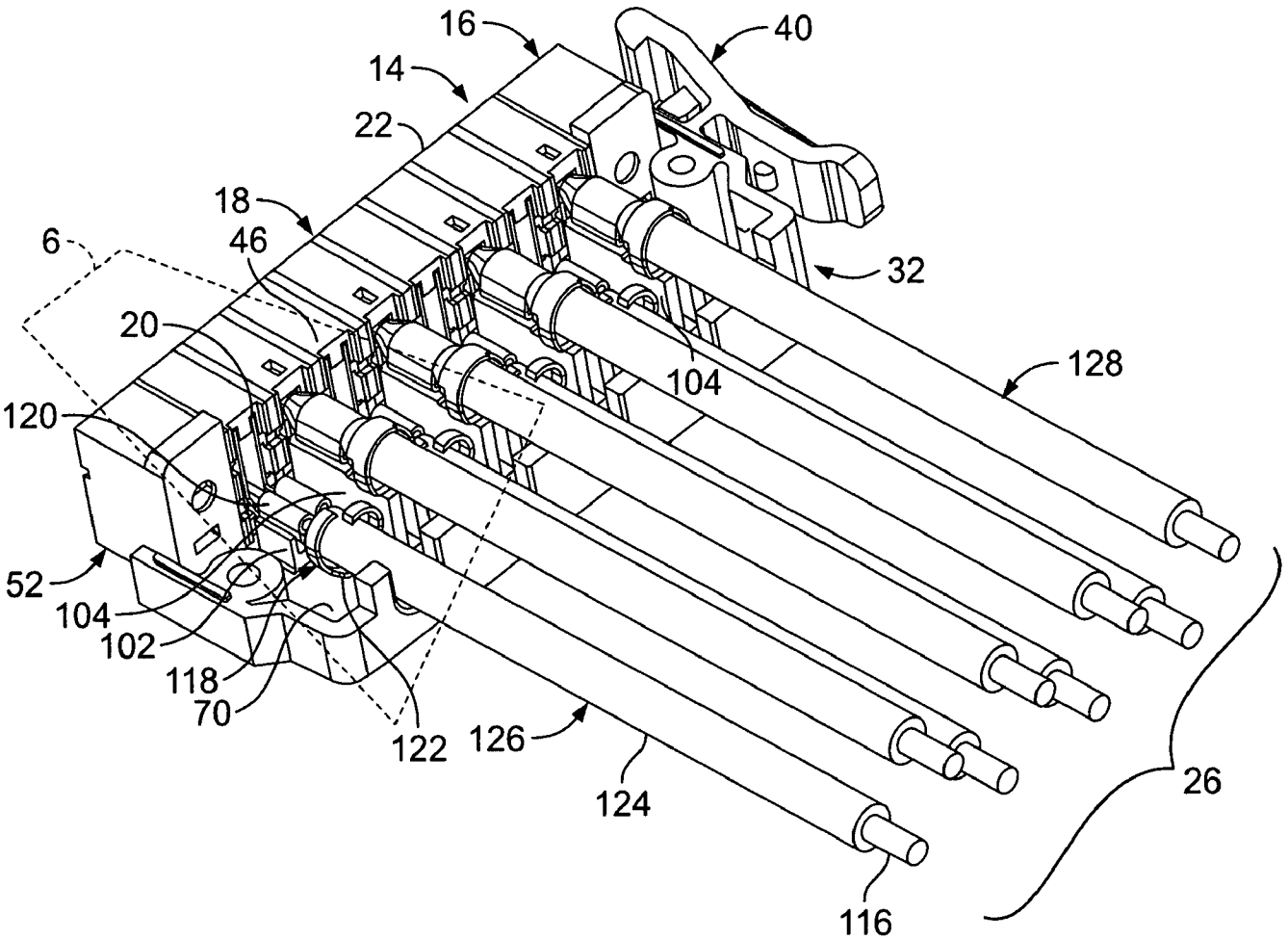
FIG. 5 is a rear perspective view of the connector assembly shown in FIG. 1 with the upper backshell housing removed.

FIG. 5 is a perspective view of the connector and backshell assembly 10 with the upper backshell housing 30 removed. The connector 14 is received in the connector receiving end 42 of the lower backshell housing 32. Each of the contacts 20 in the connector body 46 is joined to a conductor or wire 116 in one of the plurality of the electrical cables 26. Although shown with a total of eight electrical cables 26, it is to be understood that the connector 14 and backshell 12 may accept a fewer number or greater number of electrical cables 26 in other embodiments. Each contact 20 is joined to the wire 116 by an attachment element 118. In an exemplary embodiment, the attachment element 118 includes a wire barrel 120 that is attached to the wire 116 and an insulation barrel 122 that is attached to the insulation 124 of the electrical cable 26. In an exemplary embodiment, the wire barrel 120 and insulation barrel 122 are crimped to the wire 116 and insulation 124, respectively. In alternative embodiments, the contact cavities 48 (FIG. 3) may be designed to accept other contact types such as board mount contacts with solder tails or press fit pins. The cables 26 are arranged in a first row 126 and a second row 128 by the terminal cradle elements 102 and the terminal retention elements 104 on the lower backshell housing 32. The first and second rows 126 and 128 are in a tiered relationship relative to the floor 70 of the lower backshell housing 32 and the cables in the first row of 126 are offset transversely from the cables in the second row 128.

Figure 6:
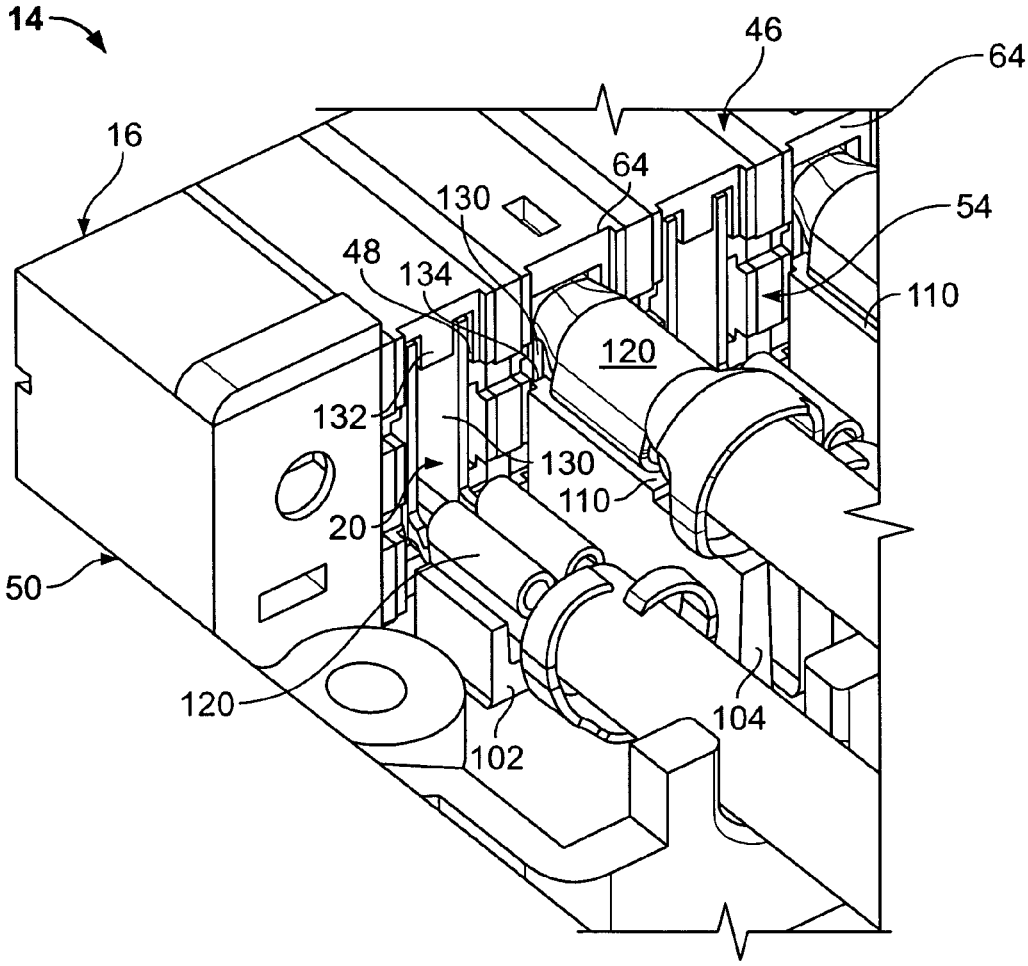
FIG. 6 is a perspective view in detail of a portion of the assembly shown in FIG. 5.

FIG. 6 is a perspective view in detail of the portion of the assembly shown in FIG. 5 illustrating a contact retention feature of the terminal retention elements 104. In one embodiment, the contacts 20 exhibit a "U" shape having legs 130 that extend from the wire barrel 120. Each of the contact cavities 48 includes a separator portion 132 that separates the legs 130 of the contacts 20. Each of the terminal retention elements 104 includes a surface 134 that is received in the recess 64 formed in the rearward face 54 of the housing main body 46. The surface 134 engages the contact legs 130 to retain the contact 20 in the connector housing 16. Adjacent contacts 20 are reversed in orientation with respect to each other. That is, where one contact 20 has its legs 130 extending upward, each adjacent contact 20, which is located in the opposite row of cables, is rotated one hundred eighty degrees so that its legs extend downward. This allows for closer spacing of the contacts 20 within the backshell 12.

Figure 7:
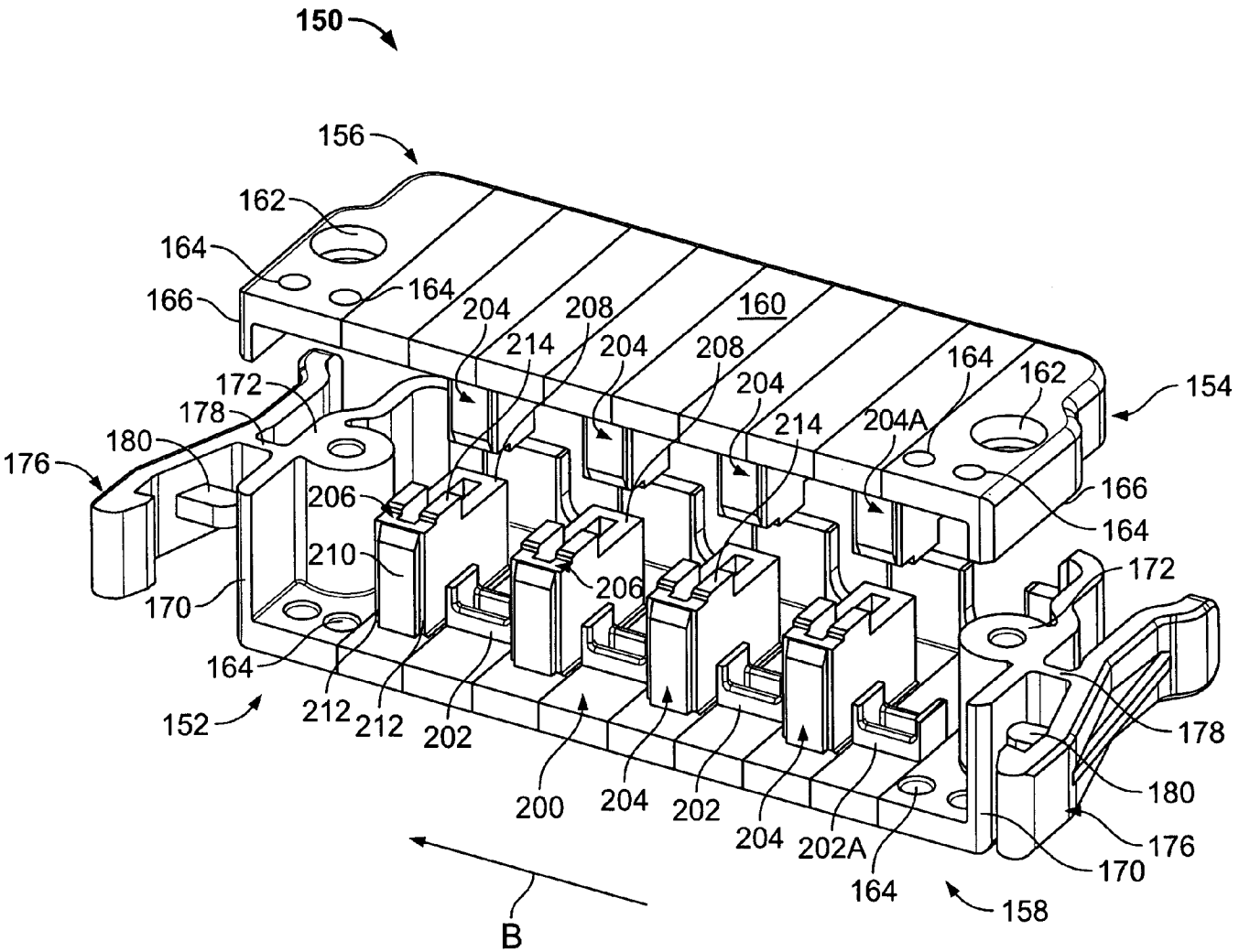
FIG. 7 is an exploded view of an alternative embodiment of a backshell formed in accordance with an exemplary embodiment of the present invention.

FIG. 7 is an exploded view of a backshell housing 150 formed in accordance with an alternative embodiment of the present invention. The backshell housing 150 has a forward connector receiving end 152 and a rearward cable exit end 154. The backshell housing 150 includes an upper backshell housing portion 156 and a lower backshell housing portion 158. The upper backshell housing 156 includes a top surface 160 that defines apertures 162 which are provided to receive fasteners (not shown) to couple the upper and lower backshell housings 156 and 158, respectively, together. Connector retention receptacles or apertures 164 that are configured to receive correspondingly shaped protrusions formed on a connector housing (not shown) are provided to retain the connector housing in the connector receiving end 152 of the backshell 150 when the upper and lower backshell housings 156 and 158, respectively, are joined. The connector retention apertures 164 are positioned proximate the connector receiving end 152 of the backshell housing 150. The upper backshell housing 156 includes opposed side walls 166 that are substantially identical to each other.

The lower backshell housing 158 includes opposed side walls 170 that are also substantially identical to one another. Posts 172 are provided on the interior of the lower side walls 170 to receive fasteners to couple the lower backshell housing 158 to the upper backshell housing 156. Connector retention apertures 164 are also provided in the lower backshell housing 158. In the embodiment illustrated in FIG. 7, the lower side walls 170 are substantially equal in height and each includes a latch member 176 to latch the backshell 150 and a connector (not shown) mounted therein to a mating connector (not shown). In an exemplary embodiment, the latch members 176 are squeeze-to-release latches that are integrally formed with the side walls 170 and include living hinges 178. The latch members 176 also include forwardly positioned stress limiters 180 as well as rearwardly positioned stress limiters (not shown) to prevent overstress damage to the latch members 176.

The lower backshell housing 158 includes a plurality of organizing elements 200 that are arranged in a transverse row in the direction of the arrow B. The organizing elements 200 include alternating terminal cradle elements 202 and terminal retention elements 204. A similar row of organizing elements 200 is formed in the upper backshell housing 156, however only the terminal retention elements 204 are visible in FIG. 7. The terminal cradle elements 202 and the terminal retention elements 204 in the upper backshell housing 156 are offset transversely from like organizing elements in the lower backshell housing 158. That is, the rightmost organizing element in the lower backshell housing 158 is the terminal cradle element 202A, while the rightmost organizing element in the upper backshell housing 156 is the terminal retention element 204A. Thus, each terminal cradle element 202 in the lower backshell housing 158 is vertically aligned with one of the terminal retention elements 204 in the upper backshell housing 156 and transversely offset from a terminal cradle element 202 in the upper backshell housing 156. Similar relationships exist with regard to the terminal retention elements 204. The terminal cradle elements 202 and the terminal retention elements 204 that comprise the organizing elements 200 cooperate to arrange electrical cables 26 (FIG. 5) in first and second transverse rows wherein the first and second transverse rows are in a tiered relationship with one another and wherein both the electrical cables 26 and like organizing elements 200 are transversely offset from one another.

In an exemplary embodiment, each terminal retention element 204 includes a front wall 206 and a rear wall 208 opposite the front wall 206. The front wall includes an extended front face 210 and shouldered surfaces 212 adjacent the front face 210. The front face 210 is received in the recesses 64 in the rearward face 54 of the connector housing 16 (FIG. 3) to engage the electrical contacts 20 (FIG. 6) in the connector housing 16 to retain the contacts 20 in the connector housing 16. The shouldered surfaces 212 engage the rearward face 54 of the connector housing 16 alongside the contact channels 48. The terminal retention elements 204 also include stepped cable engagement surfaces 214.

Figure 8:
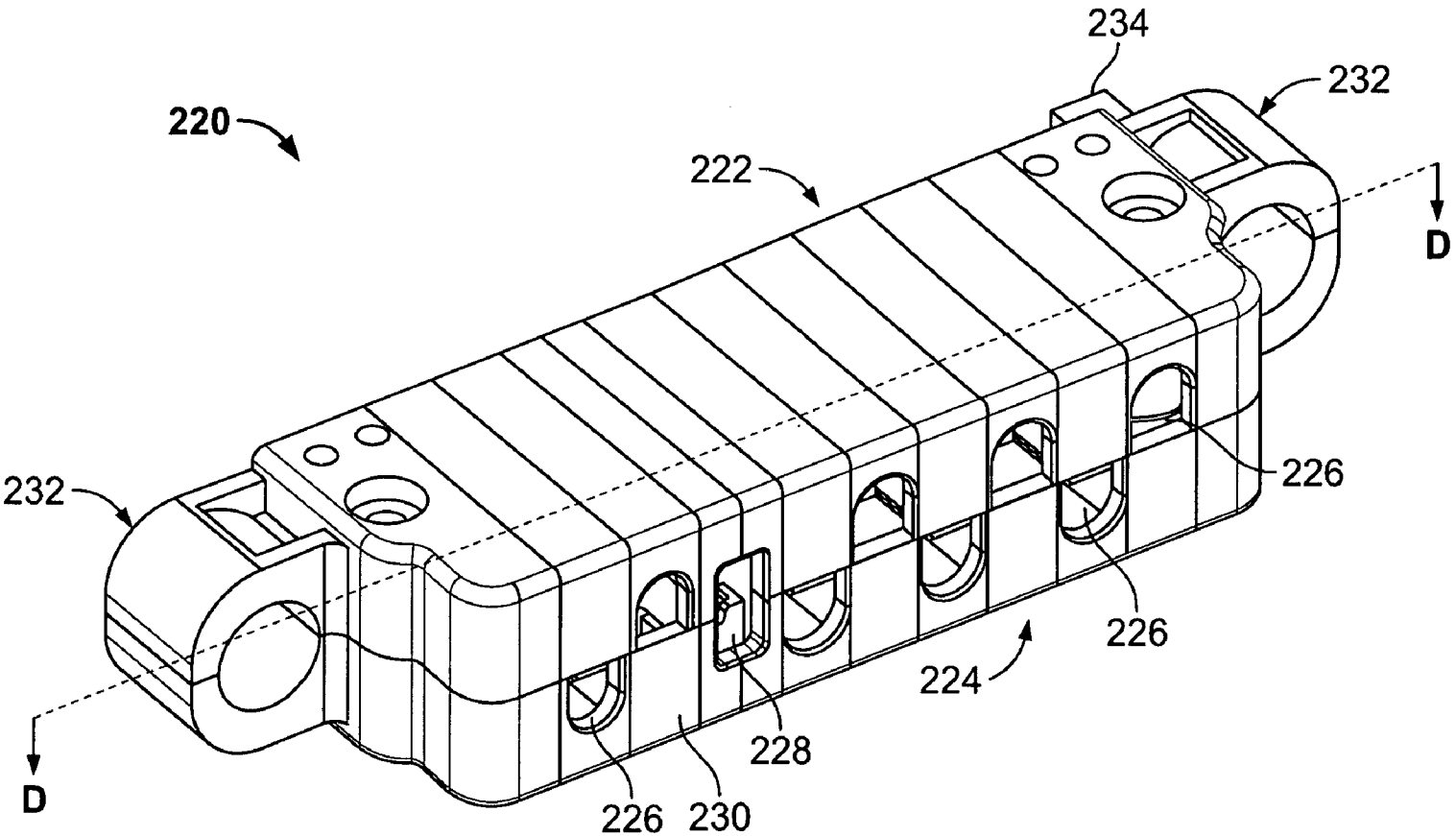
FIG. 8 is a perspective view of a panel mount backshell formed according to an alternative embodiment of the present invention.

FIG. 8 is a perspective view of a backshell housing 220 formed according to an alternative embodiment of the present invention. The backshell housing 220 is configured to be mounted to a panel (not shown). The backshell housing 220 has a forward connector receiving end 222 and a rearward cable exit end 224. The cable exit end 224 includes cable exits 226 and a signal channel 228 formed in a rear wall 230 of the backshell housing 220. The backshell housing 220 includes mounting ears 232 for attachment of the backshell housing 220 to the panel. In one embodiment, the backshell housing 220 is coupled to the panel using shoulder screws (not shown) wherein, rather than a tight fit, the backshell housing 220 floats on the shoulder screws. A mounting key 234 extends from the connector receiving end 222 of the backshell housing 220. The mounting key 234 is received in a receptacle (not shown) on the panel (not shown). The mounting key 234 and the panel receptacle cooperate to assure proper orientation of the backshell housing 220 with respect to the panel.

Figure 9:
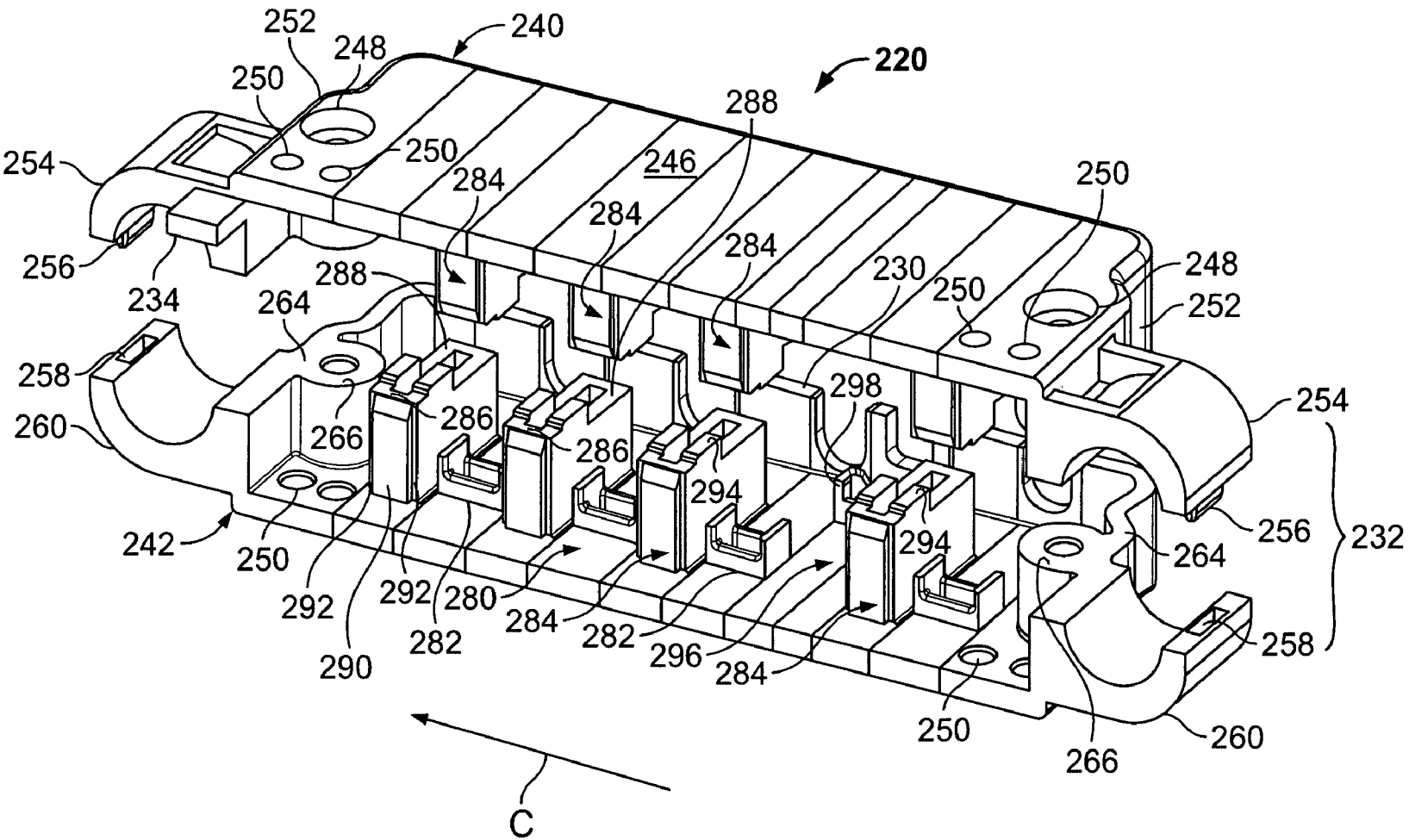
FIG. 9 is an exploded view of the backshell shown in FIG. 8.

FIG. 9 is an exploded view of the backshell housing 220 shown in FIG. 8. The backshell housing 220 includes an upper backshell housing portion 240 and a lower backshell housing portion 242. The upper backshell housing 240 includes a top surface 246 that defines apertures 248 which are provided to receive fasteners (not shown) to couple the upper and lower backshell housings 240 and 242, respectively, together. Connector retention receptacles or apertures 250 that are configured to receive correspondingly shaped protrusions formed on a connector housing (not shown) are provided to position and retain the connector housing in the connector receiving end 222 of the backshell 220 when the upper and lower backshell housings 240 and 242, respectively, are joined. The connector retention apertures 250 are positioned proximate the forward connector receiving end 222 of the backshell housing 220. The upper backshell housing 240 includes opposed side walls 252 each of which includes an upper portion 254 of the mounting ears 232. Each mounting ear upper portion 254 includes a tab 256 that is received in a slot 258 in a lower portion 260 of the mounting ears 232 when the upper and lower backshell housings 240 and 242, respectively, are coupled together.

The lower backshell housing 242 includes opposed side walls 264 that are also substantially identical to one another. Posts 266 are provided on the interior of the lower side walls 264 to receive fasteners to couple the lower backshell housing 242 to the upper backshell housing 240. Connector retention apertures 250 are also provided in the lower backshell housing 242. The mounting ear lower portions 260 are formed on the lower backshell housing side walls 264.

The lower backshell housing 242 includes a plurality of organizing elements 280 that are arranged in a transverse row in the direction of the arrow C. The organizing elements 280 include alternating terminal cradle elements 282 and terminal retention elements 284. A similar row of organizing elements is formed in the upper backshell housing 240, however only the terminal retention elements 284 are visible in FIG. 9. The terminal cradle elements 282 and the terminal retention elements 284 in the upper backshell housing 240 are offset transversely from like organizing elements in the lower backshell housing 242. That is, each terminal cradle element 282 in the lower backshell housing 242 is vertically aligned with one of the terminal retention elements 284 in the upper backshell housing 240 and transversely offset from a terminal cradle element 282 in the upper backshell housing 240. The same relationship exists with regard to the terminal retention elements 284. The terminal cradle elements 282 and the terminal retention elements 284 that comprise the organizing elements 280 cooperate to arrange electrical cables 26 (FIG. 5) in first and second transverse rows wherein the first and second transverse rows are in a tiered relationship with one another and the cables 26 in each row are transversely offset from the cables 26 in the other row. In an exemplary embodiment, each terminal retention element 284 includes a front wall 286 and a rear wall 288 opposite the front wall 286. The front wall includes an extended front face 290 and shouldered surfaces 292 adjacent the front face 290. The terminal retention elements 284 also include stepped cable engagement surfaces 294.

The backshell housing 220 may be configured to accept both power and signals. Signal circuits carry relatively low current and may be used for switching or other control circuits. In one embodiment, each of the upper and lower backshell housings 240, 242, includes a channel 296 that is provided to receive a signal cable housing 302 carrying signal cables 310 (see FIG. 10). A retaining member 298 is provided adjacent the rear wall 230 of both the upper and lower backshell housings 240, 242 to retain the signal cable housing 302 (FIG. 10).

Figure 10:
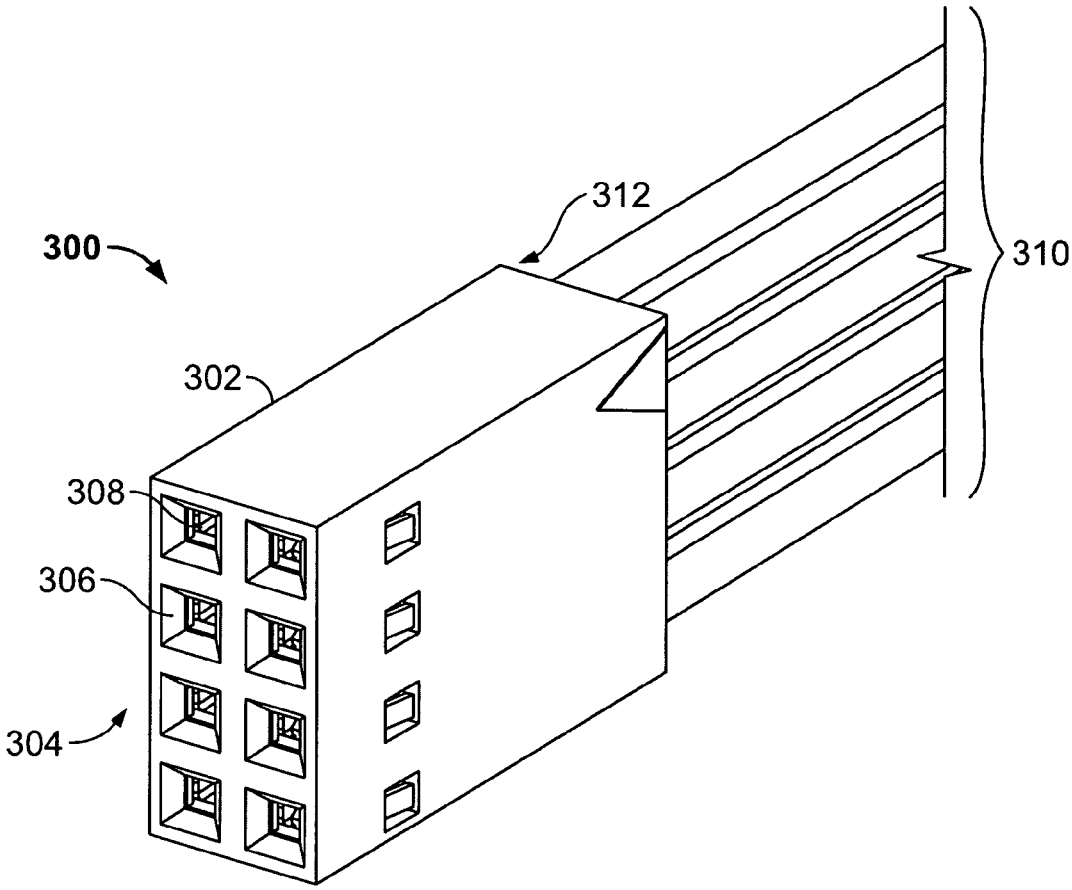
FIG. 10 is a perspective view of a signal block which may be used with the backshell shown in FIGS. 8 and 9.

FIG. 10 is a perspective view of a signal cable subassembly or signal block 300 which may be used with the backshell 220 shown in FIGS. 8 and 9. The signal block 300 includes a signal cable housing 302 that has a mating face 304. A plurality of contact channels 306 hold electrical contacts 308 that are joined to a plurality of signal cables 310 that exit a rear face 312 of the signal cable housing 302.

Figure 11:
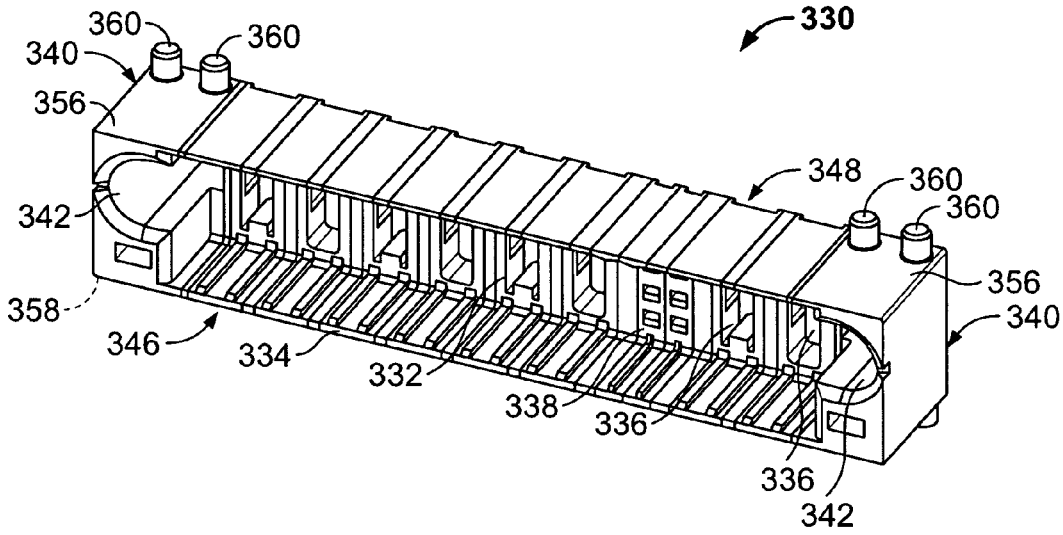
FIG. 11 is a front perspective view of a connector housing which may be used with the backshell shown in FIGS. 8 and 9.

FIG. 11 is a front perspective view of a connector housing 330 which may be used with the backshell housing 220 shown in FIGS. 8 and 9. The connector housing 330 includes a main body 332 from which a shroud 334 forwardly extends. The body 332 includes a plurality of contact cavities 336. The contact cavities 336 may be designed to accept either board mount contacts with solder tails or press fit pins, as well as, cable contacts such as the contacts 20 (FIG. 6) with wire and insulation crimp barrels 120, 122 (FIG. 6) for attachment of the contacts 20 to a wire. The body 332 may also include a signal contact section 338 that is provided to accommodate signal transmission. The connector housing 330 also includes end portions 340 each of which includes a guidepost channel 342 that extends from a forward mating face 346 to a rearward face 348 of the main body 332 which also corresponds to a rear face of the connector housing 330. The guidepost channels 342 are sized and configured to receive a guidepost (not shown) from a mating connector (not shown) to position and align the connector housing 330 with the mating connector. The end portions 340 also include upper and lower surfaces 356 and 358, respectively. Protrusions 360 extend from the upper and lower surfaces 356 and 358, respectively, proximate the rearward face 348 of the connector housing 330.

Figure 12:
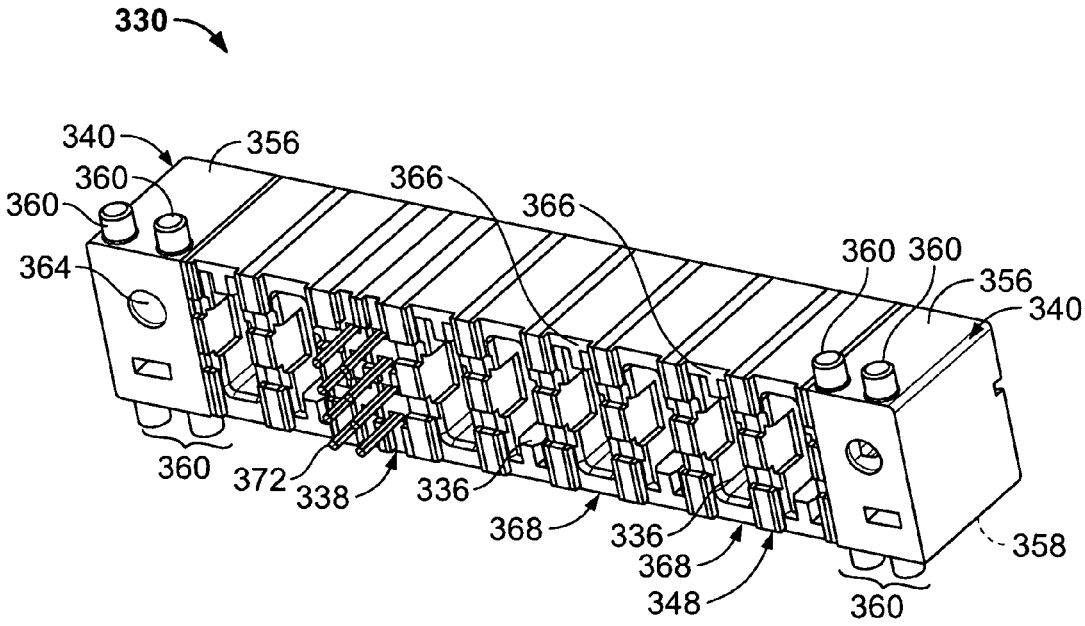
FIG. 12 is a rear perspective view of the connector housing shown in FIG. 11.

FIG. 12 is a rear perspective view of the housing 330. Each of the guidepost channels 342 terminates at a guidepost hole 364 in the end portions 340 proximate the rearward face 348 of the connector housing 330. The guidepost holes 364 are configured to receive a conical tip of the guidepost (not shown) of the mating connector (not shown). The rearward face 348 of the main body 332 includes a plurality of recessed areas 366 at a rearward end 368 of each contact cavity 336. Each recessed area 366 receives the front face 290 of one of the terminal retention elements 284 in the backshell housing 220 (FIG. 9) when the connector housing 330 is mounted in the backshell housing 220. The front face 290 of the terminal retention element 284 engages electrical contacts (not shown) in the connector housing 330 to retain the contacts in the connector housing 330. The shouldered surfaces 292 of the terminal retention elements 284 engage the rearward face 348 of the connector housing 330 alongside the contact channels 336. A plurality of signal contact pins 372 extend rearwardly from the signal contact section 338. The signal contact pins 372 are received in the contact channels 306 of the signal cable housing 302 (FIG. 10).

Figure 13:
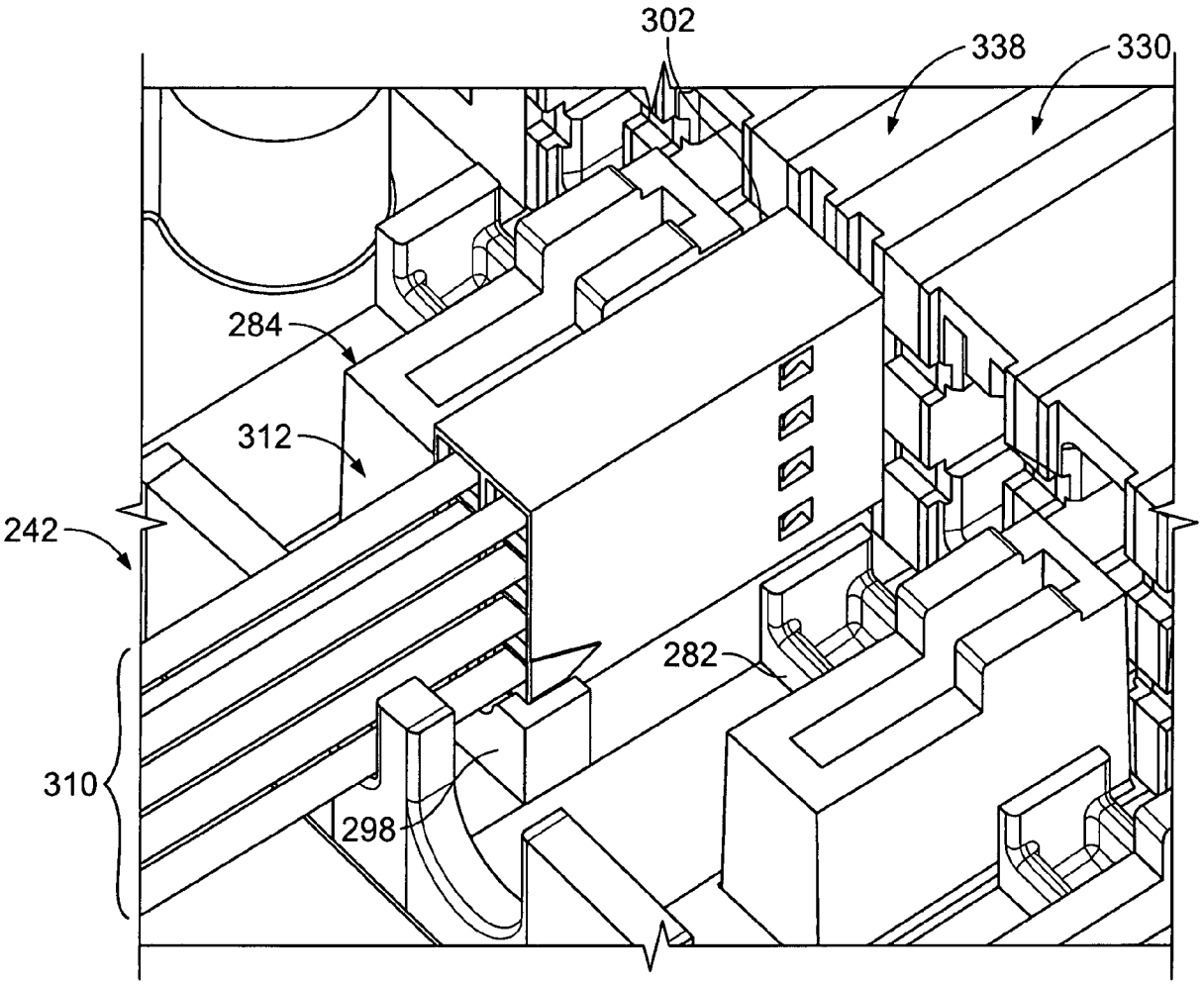
FIG. 13 is a perspective view in detail of the signal block shown in FIG. 10 loaded into the backshell and connector housings shown in FIGS. 9 and 11 respectively.

FIG. 13 is a perspective view in detail of the signal block 300 (FIG. 10) loaded into the backshell 220 (FIG. 8). With reference to the lower backshell housing 242, the signal cable housing 302 is positioned in the lower backshell housing 242 such that the signal cable housing 302 engages the retaining member 298. The signal block 300 is mated with the connector housing 330 so that the signal pin contacts 372 are received in the contact channels 306 in mating engagement with the contacts 308 within the signal cable housing 302. When the upper backshell housing 240 (FIG. 9) is coupled to the lower backshell housing 242, the retaining members 298 prevent removal of the signal cable housing 302 from the backshell 220.

Figure 14:
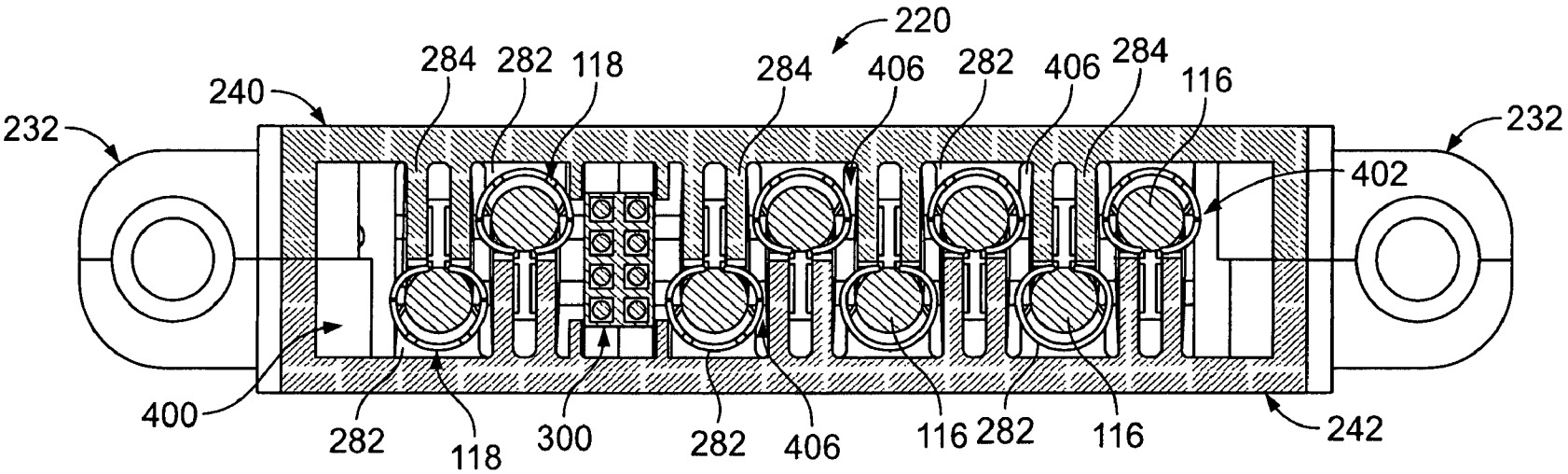
FIG. 14 is a cross sectional view of a connector and backshell assembly taken at the line D—D through the backshell shown in FIG. 8.

FIG. 14 is a cross sectional view of a connector and backshell assembly taken at the line D—D through the backshell housing 220 shown in FIG. 8 and illustrating the arrangement of cable wires 116 within the backshell housing 220. Attachment elements 118 join the cable wires 116 to contacts (not shown). Each cable is located in a terminal cradle element 282 in one of the upper backshell housing 240 and the lower backshell housing 242, and is held in place by a terminal retention element 284 from the other of the upper and lower backshell housings 240 and 242, respectively that is vertically aligned with the terminal cradle element 282. The cables are arranged in a first transverse row 400 and a second transverse row 402. Like elements, including the cable wires 116, terminal cradle elements 282, and the terminal retention elements 284 are offset from each other between the rows 400 and 402. The rows 400 and 402 are also in a tiered relationship with one being above the other. The attachment elements 118, as well as the contacts (not shown), are turned one hundred eighty degrees from adjacent attachment elements 118 and contacts in the opposite row, which achieves closer spacing of the contacts. For each cable wire 116, the adjacent and opposite terminal retention elements 284 surround the cable wire 116 to form a chamber 406 that isolates each cable wire 116 and attachment element 118 from the other cable wires 116 and attachment elements 118. The adjacent terminal retention elements 284 also restrain the cable wires 116 and attachment elements 118 from side-to-side movement within the backshell.

The embodiments thus described provide a connector assembly 10 including a backshell 12, 120, 220 that organizes and supports a plurality of cable wires coming into the backshell and the connector. The backshell includes organizing elements that isolate the contact-to-cable attachment elements from one another. Some of the organizing elements are also retention elements that retain electrical contacts in the connector. One of the connector housing and the backshell housing includes protrusions received in receptacles or recesses in the other that cooperate to retain the connector in the connector receiving end of the backshell. The backshell provides support, sealing, and strain relief for the electrical cabling to the connector so that the connector assembly is protected from damage due to mishandling or rough handling.

While the invention has been described in terms of various specific embodiments, those skilled in the art will recognize that the invention can be practiced with modification within the spirit and scope of the claims.

What is claimed is:

1. An electrical connector assembly comprising:

a connector housing holding a plurality of electrical contacts;

a backshell comprising a backshell housing having a connector receiving end and a cable exit end, said connector housing coupled to said connector receiving end of said backshell housing, said backshell housing including an upper portion and a lower portion; and a plurality of organizing elements within and joined to said backshell housing, said plurality of organizing elements comprises of organizing elements attached to said upper portion and said lower portion, said organizing elements being arranged in a transverse row within said backshell housing, said organizing elements being configured to receive and support a plurality of electrical cables arranged in first and second transverse rows, said first and second rows being in a tiered relationship with one another and wherein the electrical cables are transversely offset from one another.

2. The assembly of claim 1, wherein one of said connector housing and said backshell housing includes a protrusion and the other of said connector housing and said backshell housing includes a receptacle configured to receive said protrusion, said protrusion and said receptacle cooperating to locate said connector housing within said backshell and retain said connector housing in said connector receiving end of said backshell housing.

3. The assembly of claim 1, wherein said upper row of organizing elements being aligned opposite said lower row of organizing elements.

4. The assembly of claim 1, wherein each said row of organizing elements comprising alternating terminal retention elements and terminal cradle elements, said organizing elements in said lower row being offset transversely from corresponding organizing elements in said upper row.

5. The assembly of claim 1, wherein said plurality of electrical cables comprises a plurality of power cables and said assembly further comprises a signal block received in said backshell housing, said signal block carrying a plurality of signal cables, and wherein said connector housing includes a plurality of signal contacts extending from a rearward face thereof and extending through apertures in said signal block.

6. The assembly of claim 1, further comprising a plurality of attachment elements to couple each of said contacts to a wire in a respective one of the electrical cables, each said row of organizing elements comprising alternating terminal retention elements and terminal cradle elements, and each said attachment element being held between one of said terminal cradle elements and one of said terminal retention elements opposite said terminal cradle element.

7. The assembly of claim 1, further comprising a plurality of attachment elements to couple each of said contacts to a wire in a respective one of the electrical cables, each said row of organizing elements comprising alternating terminal retention elements and terminal cradle elements, and wherein adjacent terminal retention elements and an opposed terminal retention element cooperate to form a chamber for each said attachment element to isolate each said attachment element from an adjacent attachment element.

8. The assembly of claim 1, further comprising an attachment element to couple one of said contacts to a wire in one of said electrical cables, said attachment element comprising a wire crimp barrel and an insulation crimp barrel.

9. An electrical connector assembly comprising:

a connector housing holding a plurality of electrical contacts;

a backshell comprising a backshell housing having a connector receiving end and a cable exit end, said connector housing coupled to said connector receiving end of said backshell housing; and a plurality of organizing elements within said backshell housing, said organizing elements being arranged in a transverse row within said backshell housing, said organizing elements configured to receive and support a plurality of electrical cables arranged in first and second transverse rows, said first and second rows being in a tiered relationship with one another and wherein the electrical cables are transversely offset from one another, wherein the plurality of electrical cables comprises a plurality of power cables and said assembly further comprises a signal block received in said backshell housing, said signal block carrying a plurality of signal cables.

10. An electrical connector assembly comprising:

a connector housing holding a plurality of electrical contacts, said connector housing including a mating face and a rearward face opposite said mating face;

a backshell comprising a backshell housing having a connector receiving end and a cable exit end, said connector housing coupled to said connector receiving end of said backshell housing, said backshell housing including an upper portion and a lower portion; and a plurality of organizing elements within and formed on at least one of said upper and lower portions of said backshell housing, said organizing elements being arranged in a transverse row within said backshell housing, wherein selected organizing elements include a surface configured to be received in recesses in said rearward face of said connector housing to retain said contacts in said connector housing.

11. The electrical connector assembly of claim 10, wherein one of said connector housing and said backshell housing includes a protrusion and the other of said connector housing and said backshell housing includes a receptacle configured to receive said protrusion, said protrusion and said receptacle cooperating to locate said connector housing within said connector receiving end of said backshell housing and retain the connector housing in said connector receiving end of said backshell housing.

12. The assembly of claim 10, wherein said plurality of organizing elements comprises an upper row of organizing elements attached to said upper portion and a lower row of organizing elements attached to said lower portion, said upper row of organizing elements being aligned opposite said lower row of organizing elements.

13. The assembly of claim 10, wherein said plurality of organizing elements comprises an upper row of organizing elements attached to said upper portion and a lower row of organizing elements attached to said lower portion, each said row of organizing elements comprising alternating terminal retention elements and terminal cradle elements, said organizing elements in said lower row being offset transversely from like organizing elements in said upper row.

14. The assembly of claim 10, further comprising a signal block received in said backshell housing, said signal block carrying a plurality of signal cables, and wherein said connector housing includes a plurality of signal contacts extending from a rearward face thereof and extending through apertures in said signal block.

15. The assembly of claim 10, further comprising a plurality of attachment elements to couple each of said contacts to a wire in a respective one of a plurality of electrical cables, and wherein said plurality of organizing elements comprises an upper row of organizing elements attached to said upper portion and a lower row attached to said lower portion, each said row of organizing elements comprising alternating terminal retention elements and terminal cradle elements, and each said attachment element being held between one of said terminal cradle elements and one of said terminal retention elements opposite said terminal cradle element.

16. The assembly of claim 10, further comprising a plurality of attachment elements to couple each of said contacts to a wire in a respective one of a plurality of electrical cables, and wherein said plurality of organizing elements comprises an upper row of organizing elements attached to said upper portion and a lower row attached to said lower portion, each said row of organizing elements comprising alternating terminal retention elements and terminal cradle elements, and wherein adjacent terminal retention elements and an opposed terminal retention element cooperate to form a chamber for each said attachment element to isolate each said attachment element from an adjacent attachment element.

17. A backshell for an electrical connector, said backshell comprising:

a backshell housing having a connector receiving end and a cable exit end, wherein said backshell housing includes an upper portion and a lower portion; and a plurality of organizing elements within provided on each of said upper and lower portions of said backshell housing, said organizing elements being arranged in a transverse row within said backshell housing, said organizing elements configured to receive and support a plurality of electrical cables arranged in first and second transverse rows, said first and second rows being in a tiered relationship with one another and wherein the electrical cables are transversely offset from one another.

18. The backshell of claim 17, wherein said plurality of organizing elements comprises an upper row of organizing elements attached to said upper portion and a lower row attached to said lower portion, said upper row of organizing elements being opposite said lower row of organizing elements.

19. The backshell of claim 17, wherein said plurality of organizing elements comprises an upper row of organizing elements attached to said upper portion and a lower row attached to said lower portion, each said row of organizing elements comprising alternating terminal retention elements and terminal cradle elements, said terminal retention elements in said lower row of organizing elements being offset from terminal retention elements in said upper row of organizing elements and said terminal cradle elements in said lower row of organizing elements being offset from said terminal cradle elements in said upper row of organizing elements.

20. The backshell of claim 17, wherein said backshell housing includes a first side and a second side, each said first and second sides including a latch member configured to retain said backshell and the connector to a mating connector.

21. The backshell of claim 17, wherein said backshell housing includes a first side and a second side, each said first and second sides including a mounting ear to mount said backshell to a panel.

22. The backshell of claim 17, wherein said backshell housing is configured to partially receive a connector housing at said connector receiving end, and said backshell housing includes one of a protrusion and a receptacle configured to receive said protrusion and the connector housing includes the other of said protrusion and said receptacle, said protrusion and said receptacle cooperating to locate the connector housing within said connector receiving end and retain the connector housing in said connector receiving end of said backshell housing.

* * * * *